United States Patent [19]

Johnston et al.

[11] 4,417,781

[45] Nov. 29, 1983

[54] DIELECTRIC SEPARATION OF INCOMING AND OUTGOING TERMINATIONS IN A CABLE TERMINATION BLOCK

[75] Inventors: Harold Johnston, Lachine; Zygmunt Lask, Montreal; Frederick H. Gill, St. Bruno, all of Canada

[73] Assignee: Northern Telecom Limited, Montreal, Canada

[21] Appl. No.: 303,830

[22] Filed: Sep. 21, 1981

[51] Int. Cl.[3] ..... H01R 9/03

[52] U.S. Cl. ..... 339/198 J; 339/198 R; 339/198 E

[58] Field of Search ..... 339/198 R, 198 E, 198 J

[56] References Cited

U.S. PATENT DOCUMENTS

| | | | |
|---|---|---|---|
| 3,296,362 | 1/1967 | Parry | 339/198 R |
| 3,343,120 | 9/1967 | Whiting | 339/198 R |
| 3,760,328 | 9/1973 | Georgopulos | 339/198 R |
| 3,846,739 | 11/1974 | Devlin et al. | 339/198 J |
| 3,936,133 | 2/1976 | Splitt et al. | 339/198 R |
| 3,980,383 | 9/1976 | Dickey et al. | 339/198 R |
| 4,179,170 | 12/1979 | Splitt et al. | 339/198 R |

FOREIGN PATENT DOCUMENTS

| | | | |
|---|---|---|---|
| 955440 | 1/1957 | Fed. Rep. of Germany | 339/198 R |
| 2348018 | 4/1975 | Fed. Rep. of Germany | 339/198 R |
| 2814018 | 10/1979 | Fed. Rep. of Germany | 339/198 R |

*Primary Examiner*—John McQuade
*Assistant Examiner*—Gary F. Paumen
*Attorney, Agent, or Firm*—Sidney T. Jelly

[57] ABSTRACT

A cable termination block has terminals arranged in rows across the block, each terminal having a pin portion extending up from the top surface of the block and a socket portion in the bottom of the block. Incoming and outgoing cable conductors are attached to the pin portions, protectors plugging into the socket portions. The cable conductors are connected to alternating rows, i.e. incoming conductors to one row and outgoing conductors to the next row, and so on across the block. A dielectric member is positioned between adjacent rows of incoming and outgoing conductors. In one arrangement incoming conductors are attached to rows of long pins, outgoing conductors attached to rows of short pins. A dielectric member fits over the long pins and rests on the short pins. In another arrangement walls extend up from the block to separate adjacent rows of terminals. The walls may be inclined across the block to form tapered channels.

4 Claims, 7 Drawing Figures

DIELECTRIC SEPARATION OF INCOMING AND OUTGOING TERMINATIONS IN A CABLE TERMINATION BLOCK

This invention relates to the dielectric separation of incoming and outgoing terminations in a cable termination block, particularly in which blocks as are used in telephone lines and similar telecommunication systems.

In telephone system, line protectors are provided, at junctions between cables. Conductors from one cable, e.g. the incoming cable, are brought in and connected to a first series of terminal pins and conductors from the other cable, e.g. the outgoing cable, are connected to a second series of terminals. The terminals are in turn connected to terminals of a protector, the protector in series with the cable conductors.

The conductors of the one cable are brought in from one side edge of a terminal block, the terminals extending across the block. Similarly the conductors of the other cable are brought in, on the opposite side edge of the termination block, the terminals for these conductors also extending across the block. The two series of terminals generally extend across the block side-by-side.

The conductors are split up into groups, for example of twenty conductors, each group connected to a line of terminals extending across the block. The subdivision is made for both cables.

It will be appreciated that at the beginning of a line of terminals, adjacent one side edge, there will be twenty conductors, but the number of conductors will decrease as connections are made to terminals across the block, finishing up with a single conductor at the end of the line of terminals. Similarly, in the other direction, there are at first twenty conductors, decreasing to one. Thus, across the terminal block, as the number of conductors from one cable decrease, the number of conductors from the other cable decrease. It has therefore been a practice to in effect overlap the conductors from each cable along the side of a line of terminals, to reduce space, as the overall number of conductors remains constant from one side of the block to the other.

However, such arrangements have led to insulation breakdown and shorting or crossing from conductors of one cable to conductors of the other cable, due, amongst other reasons for burning out of one or more incoming conductors, when voltage surges occur, such as due to lightning or contact between power lines and telephone lines.

The present invention provides a termination block in which there is dielectric spacer between the conductors of one cable and the conductors of another cable. This can be done in a number of ways. For example, members can extend up from the surface of the block, forming separate channels for the two sets of conductors. The channels can be tapered alternately in each direction to accommodate the reducing number of conductors across the block. In an alternate arrangement, the terminal pins for one cable are shorter than those for the other, and a dielectric member is positioned over the longer terminal pins, after connection of conductors to the shorter terminals. The long terminals pass through holes in the dielectric member, which rests on top of the short terminals. Conductors can then be connected to the tops of the long terminals. With the conductors of one cable below the dielectric member and the conductors of the other cable above the dielectric member, separation is obtained and power crossing prevented.

The invention will be readily understood by the following description of certain embodiments, by way of example, in conjunction with the accompanying drawings, in which.

Figure 2:
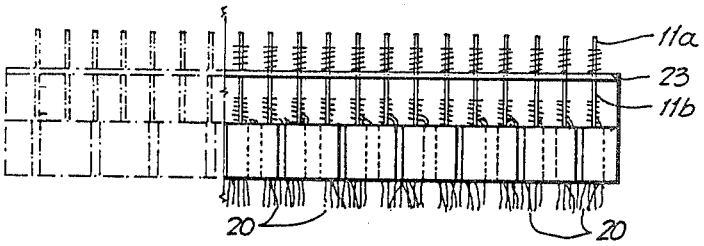
FIG. 2 is an end view in the direction of arrow B in FIG. 1.
Figure 1:
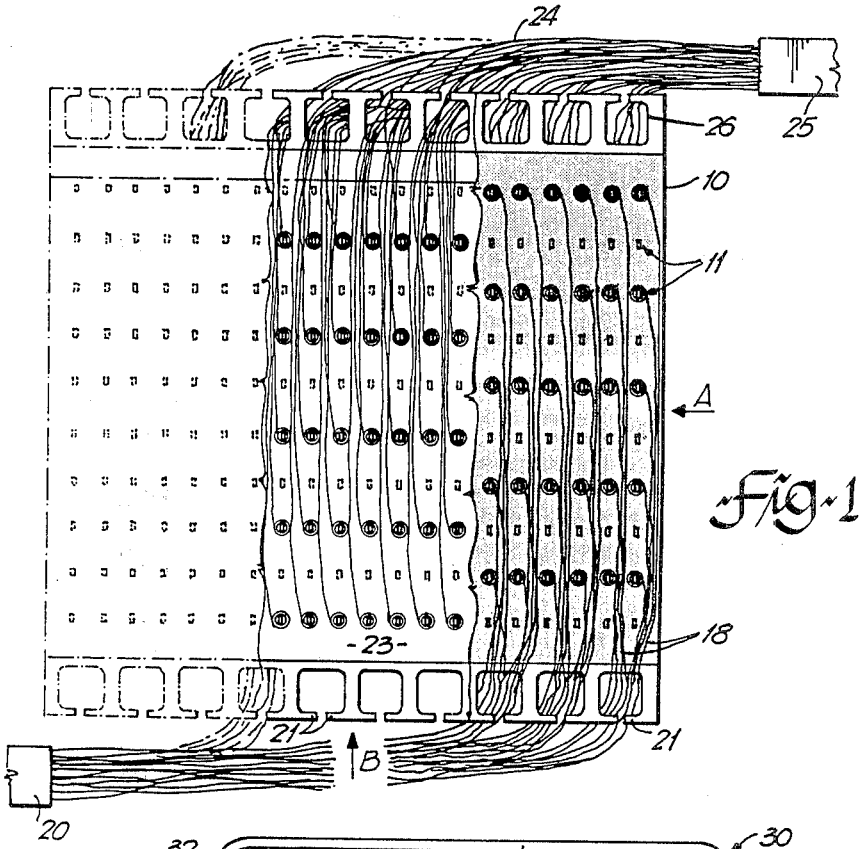
FIG. 1 is a top plan view of one form of termination block with long and short terminals, with part of a dielectric separator omitted to show the lower layer.
Figure 3:
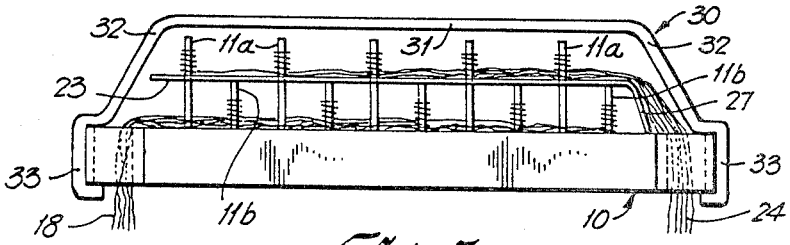
FIG. 3 is a side view in the direction of arrow A in FIG. 1, with a protective cover positioned on the block.

Considering first FIGS. 1, 2 and 3, a termination block comprises a rectangular block 10 having rows of terminal pins 11 extending from one end to the other. The pins 11, as will be seen in FIG. 3, alternate along a row, being alternately long and short, long pins indicated at 11*a* and short pins at 11*b*. The pins are inserted with a push fit into the block 10.

The terminal pins, at their lower ends, in the block 10, are formed into tubular sockets for insertion of pins of a voltage overload protector. Thus, in the example two long pins 11*a* and two short pins 11*b*, for example the first two long pins in two adjacent rows and the first two short pins in the same two rows form a unit to accept four pins of a protector. The terminal pins are formed, with the tubular portion, prior to insertion, and inserted from the back of bottom surface of the block 10.

The conductors from one cable are fed in from one end of the block while the conductors from the other cable enter from the other end of the block. As seen in FIG. 1, conductors 18 from one cable, indicated at 20, are separated into groups, via guidance and containing rings 21, formed at one end of the block. The conductors are then fed along one side of a row of pins, with the conductors 20, in the example, being connected to the short pins 11*b*. This is as at the right hand side of FIG. 1. When all of the conductors have been brought up through the rings 21 and connected to the short pins 11*b*, a flat dielectric member 23 is positioned over the long pins to rest on the top of the short pins, as seen particularly in FIG. 3.

The conductors 24 from the other cable indicated at 25 (FIG. 1) are then brought up through rings 26 at the other end of the block. The end of the dielectric member 23 is bent down to meet the block just inside the rings 26, as shown at 27 in FIG. 3, to avoid a sharp edge being presented to the conductors 25. The conductors are fed along one side of a row of pins, long pins 11*a*, the conductors being connected thereto. This is as shown at the center of FIG. 1.

The conductors are connected to the pins in any convenient manner; in the drawings they are connected by wire-wrapping. It is a feature of this embodiment that the conductors from the incoming cable are on top, that is connected to the long pins, while the conductors of the outgoing cable are connected to the short pins.

FIG. 3 also illustrates a protective cover 30 which can be provided, snapping on over the ends of the block, extending over the terminal pins and conductors. The cover 30 is conveniently made from a length cut from an extrusion, of stiff but flexible plastic material.

The cover has a main central flat web 31, inclined sides 32 with channel shaped formations 33 at the bottom edges of the sides. To apply the cover, the sides are flexed apart slightly and the channel shaped formations 33 engaged over the body 10.

Figure 4:
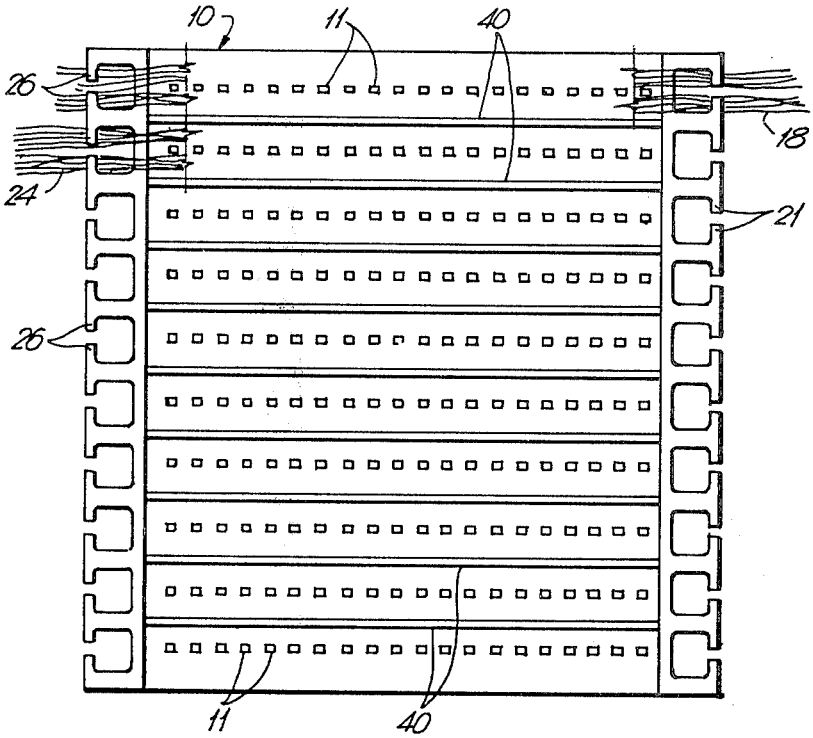
FIG. 4 is a top plan view of an alternative form of termination block.
Figure 5:
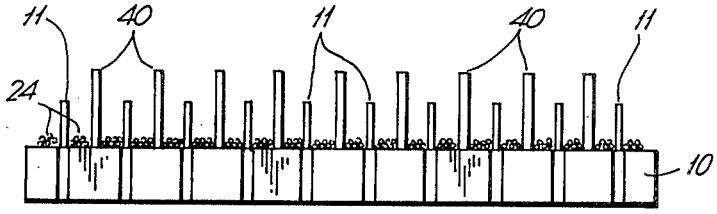
FIG. 5 is an end view of the terminal block of FIG. 4.

FIGS. 4 and 5 illustrate an arrangement in which all the pins 11 are of the same height, arranged in rows the length of the body 10. The rows of pins are isolated from each other by walls 40 which extend up from the top of the body, and conveniently are molded integral therewith. The conductors 20 and 25, from two cables, enter from opposite ends, as in FIGS. 1, 2 and 3 and the conductors of one cable, for example conductors 25, enter alternate rows from one end , the other conductors 20 enter the remaining rows from the other end. The conductors are attached as desired, for example by wire wrapping. The conductors are passed up through rings 21 and 26 as in FIGS. 1 to 3.

The arrangement of FIGS. 4 and 5 does not make the most use of the space available as there is excess space between rows at the ends remote from the ends at which conductors enter. This is because the number of conductors decrease along a row as individual conductors are attached to pins.

Figure 6:
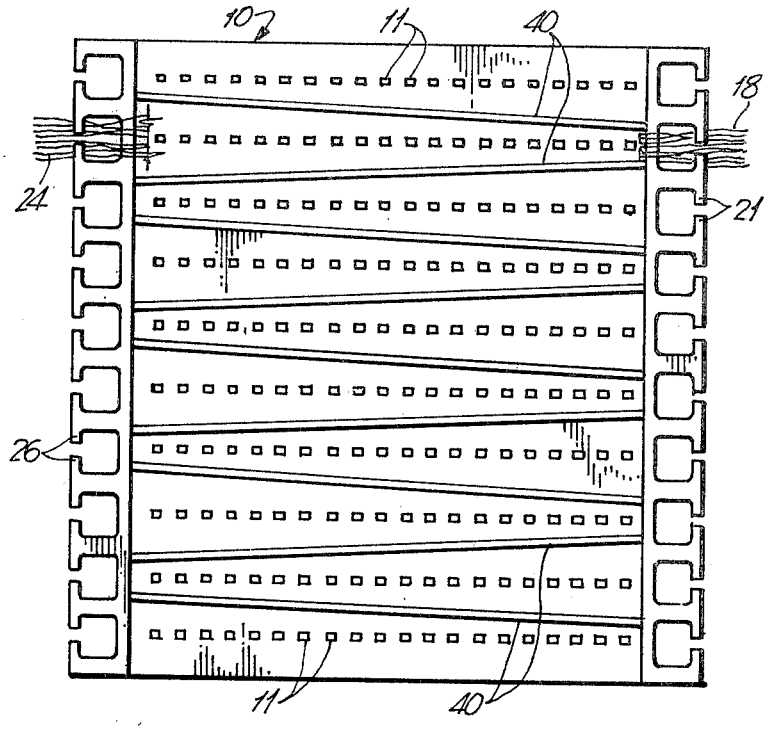
FIG. 6 is a top plan view of a further form of termination block.
Figure 7:
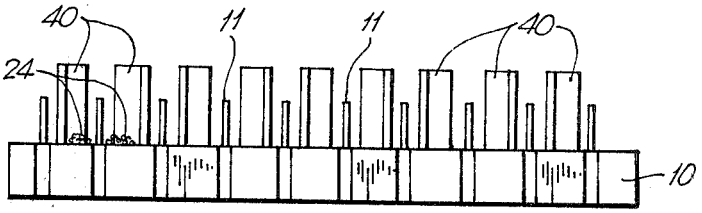
FIG. 7 is an end view of the block of FIG. 5.

FIGS. 6 and 7 illustrate an arrangement in which the rows of pins 11 are again all of the same length, and are separated by walls 80, but in this example the walls are inclined or angled across the block. Thus the distance between a pair of walls 40 decreases across the block, defining tapered channels, the conductors entering from the wide end. The number of conductors decrease across the block as the space between walls decreases and thus more effective use of space is obtained. The taper of the channels alternates, the wide end of one channel adjacent the narrow end of the adjacent channel.

In both of the examples of FIGS. 4 and 5, and FIGS. 6 and 7, a snap-on cover is provided, as in FIG. 3. The block 10 in the arrangement of FIGS. 6 and 7 can be made narrower for the same number of conductors as in FIGS. 4 and 5, or a larger number of conductors can be accommodated.

In the embodiment of FIGS. 1, 2 and 3, even though the long pins 11*a* pass in close proximity to the conductors 20 connected to the short pins 11*b*, danger of shorting between the long pins and conductors 20 is extremely minimal. This is obtained by, as described, connecting the incoming cable conductors to the long pins. Thus any overvoltage occurs on the incoming conductors. If the overvoltage is such that it affects a conductor, the conductor burns out at its connection to the pin. The pin is capable of withstanding the overload to a greater extent than the conductor and does not heat up to the extent that it will burn the conductors 20.

It will be appreciated that in the conventional arrangement with incoming and outgoing conductors adjacent to each other, burning out of one or more incoming conductors rapidly spreads to other conductors, causing shorting. Quite a large burnt out area can result. With the present invention the incoming conductors are always separated from the outgoing conductors. Thus if a burn out occurs it is localized. Further, replacement is easy in that it is always the incoming cable affected and this can readily be replaced, without affecting the outgoing cable conductors.

What is claimed is:

1. A cable terminating block comprising;

a rectangular block of dielectric material;

a plurality of rows of terminals extending along the block from one end to the other, and a plurality of terminals in each row, the rows spaced to define spaces for cable conductors;

each terminal including a terminal pin at one end extending from a top surface of said block and a terminal socket at the other end positioned within said block at a bottom surface thereof;

each row of terminals consisting of alternating long terminal pins and short terminal pins;

means at one end of said block for positioning conductors from a first cable for passage along said spaces and connection to the outer ends of said long terminal pins;

means at the other end of said block for positioning conductors from a second cable for passage along said spaces and connection to said short terminal pins;

a flat sheet-like dielectric member extending over said block and having rows of holes therein, a hole for each long terminal pin, the holes spaced to fit over said long terminal pins, the dielectric member resting on the short terminal pins, the conductors of said second cable extending below said dielectric member when connected to said short terminal pins and the conductors of said first cable extending above said dielectric member when connected to said long terminal pins.

2. A terminating block as claimed in claim 1, including:

an incoming stub cable having a plurality of incoming conductors, said incoming conductors entering at one end of said block and connected sequentially to the outer ends of said long terminal pins of said rows of terminals;

an outgoing stub cable having a plurality of outgoing conductors, said outgoing conductors entering at the other end of said block and connected sequentially to the ends of said short terminal pins of said rows of terminals.

3. A terminating block as claimed in claim 1, said means at one end and said means at the other end, of said block, comprising guide rings, the conductors from the cables being positioned in said guide rings when said conductors are connected to said terminal pins.

4. A terminating block as claimed in claim 3, including a snap-on cover for extending over said terminal pins, said cover snapping on at each end of said block, said cover engaging over said guide rings.

* * * * *